US009096413B2

(12) United States Patent
Gryzan et al.

(10) Patent No.: US 9,096,413 B2
(45) Date of Patent: Aug. 4, 2015

(54) CRANE HAVING A CRANE JIB, IN PARTICULAR A BRACKET CRANE

(75) Inventors: Timo Gryzan, Monheim (DE); Peter Köhn, Düsseldorf (DE); Eberhard Becker, Hagen (DE); Dieter Eichler, Leverkusen (DE); Björn Winter, Wetter (DE); Michael Kaminski, Bochum (DE)

(73) Assignee: Terex MHPS GmbH, Düsseldorf (DE)

( * ) Notice: Subject to any disclaimer, the term of this patent is extended or adjusted under 35 U.S.C. 154(b) by 141 days.

(21) Appl. No.: 13/988,682

(22) PCT Filed: Nov. 18, 2011

(86) PCT No.: PCT/EP2011/070430

§ 371 (c)(1),
(2), (4) Date: Jun. 18, 2013

(87) PCT Pub. No.: WO2012/069370

PCT Pub. Date: May 31, 2012

(65) Prior Publication Data

US 2014/0001137 A1 Jan. 2, 2014

(30) Foreign Application Priority Data

Nov. 26, 2010 (DE) ..... 10 2010 060 846

(51) Int. Cl.
*B66C 19/00* (2006.01)
*B66C 23/24* (2006.01)

(52) U.S. Cl.
CPC ..... *B66C 19/00* (2013.01); *B66C 23/24* (2013.01)

(58) Field of Classification Search
USPC ..... 212/179, 319, 73, 271
See application file for complete search history.

(56) References Cited

U.S. PATENT DOCUMENTS 707,660 A 8/1902 Watlington
2,294,998 A * 9/1942 Mitchell ..... 248/282.1

(Continued)

FOREIGN PATENT DOCUMENTS

CH 682229 A5 8/1993
DE 1135640 8/1962

(Continued)

OTHER PUBLICATIONS

International Search Report of the International Searching Authority for International Application No. PCT/EP2011/070430 completed Jan. 26, 2012.

(Continued)

*Primary Examiner* — Emmanuel M Marcelo
(74) *Attorney, Agent, or Firm* — Gardner, Linn, Burkhart & Flory, LLP

(57) ABSTRACT

A crane comprising a laterally projecting crane jib on which a hoisting device is arranged and which is connected to at least one carrier body, which, together with the crane jib, can travel along an upper guide rail and a lower guide rail by way of traveling gears, wherein in each case the upper and the lower guide rails, and correspondingly, the traveling gears, are arranged spaced vertically from one another. In order to provide a crane comprising a laterally projecting crane jib, in particular a bracket crane or a traveling crane, the manufacture, transport and installation of which are optimized, according to the invention the at least one carrier body is designed as one component and connecting surfaces are arranged on said carrier body, to which a respective traveling gear and the crane jib can be detachably fastened.

17 Claims, 4 Drawing Sheets

(56) References Cited

U.S. PATENT DOCUMENTS

| | | | | |
|---|---|---|---|---|
| 2,766,892 | A * | 10/1956 | Graber | 211/96 |
| 2004/0238471 | A1 * | 12/2004 | Lissandre | 212/177 |

FOREIGN PATENT DOCUMENTS

| | | | |
|---|---|---|---|
| DE | 1175840 | | 8/1964 |
| DE | 1229262 | | 11/1966 |
| DE | 10021297 | A1 | 11/2001 |
| EP | 0544139 | A1 | 6/1993 |
| JP | 53136764 | A | 11/1978 |

OTHER PUBLICATIONS

Written Opinion of the International Searching Authority for International Application No. PCT/EP2011/070430.

English translation of International Preliminary Report on Patentability from corresponding International Application PCT/EP2011/070430.

* cited by examiner 1
3
A
3b
3c
3d
5
V
7a
6a
6
4a
14a
7
2
4c
8f
8a
14c
8
14b
8b
8d
8c
4b
6b
2b
2c
2e
3h
3f
3g
3e
2d
2f 1
2a
4d
4a
12
7b
14a
7
7a
3
3a
2d
2
3f
4f
2c
4c
8e
8f
2b
4e
14c
4b
8d
14b
8c

CRANE HAVING A CRANE JIB, IN PARTICULAR A BRACKET CRANE

CROSS REFERENCE TO RELATED APPLICATIONS

The present application claims the priority benefits of International Patent Application No. PCT/EP2011/070430, filed on Nov. 18, 2011, and also of German Patent Application No. DE 10 2010 060 846.7, filed on Nov. 26, 2010, which are hereby incorporated herein by reference in their entireties.

BACKGROUND OF THE INVENTION

The invention relates to a crane having a laterally projecting crane jib on which a hoisting device is disposed and which is connected to at least one support body which, together with the crane jib, can travel along an upper running rail and a lower running rail via travelling mechanisms, wherein in each case the upper and the lower running rails and accordingly the travelling mechanisms are disposed so as to be vertically spaced apart from each other.

European patent document EP 0 544 139 B1 discloses a bracket crane for moving loads by means of at least one crane jib. A hoisting device is accommodated on the crane jib so as to be able to travel by means of a trolley and is used to raise and lower the load. The crane jib is guided on, and can travel along, an upper and lower running rail in a freely laterally projecting manner on one end via an upper and a lower travelling mechanism. The travelling mechanisms each comprise two running wheels and are attached to the crane jib so as to be offset with respect to each other horizontally and vertically in relation to the longitudinal direction of the crane jib. The running rails extend in parallel with each other horizontally and transversely with respect to the crane jib and are attached to a wall or an elevated support structure. The lower travelling mechanism is attached by means of a downwardly directed vertical holder to an end of the crane jib remote from the free end of the crane jib. The running wheels of the lower travelling mechanism run on a lower side of the lower running rail. The running wheels of the upper travelling mechanism run on the upper running rail. The upper travelling mechanism is attached directly to the crane jib. In this manner, the forces or moments resulting from the acceleration or own weight of the crane elements and any load are fed into the running rails or supports via the running wheels of the travelling mechanisms. The crane jib may also be pivotable in a horizontal plane.

German patent document DE 1 135 640 B discloses a comparable bracket crane having a crane jib which is fixedly connected to a bracket acting as a travelling mechanism girder. The bracket crane consists substantially of two parts which are fixedly connected together at the destination of the bracket crane. The frame-shaped bracket is composed of a T-shaped girder and a U-shaped girder for this purpose. The crane jib is fixedly connected to a horizontal region of the T-shaped girder. The T-shaped girder is also fixedly connected at its two ends, in each case via a flange, to each vertical limb of the U-shaped girder. Disposed on the base of the T-shaped girder and, in a vertically offset manner, on the limbs of the U-shaped girder of the assembled bracket are pairs of travelling mechanisms or running wheels for feeding forces or moments into an upper and a lower longitudinal rail and for travelling on the longitudinal rails.

German laid-open document DE 100 21 297 A1 discloses a bridge crane having a main girder which can travel transversely with respect to its longitudinal direction along two running rails extending in parallel. For this, a head girder provided with travelling mechanisms is disposed in each case on the opposite ends of the main girder and the head girders are used to support the main girder on the running rails. The head girders are releasably attached by means of screws to the main girder via in each case a connection part having angle plates. A hoisting device is also suspended on the main girder and can travel along the main girder.

Comparable bridge cranes having main girders fixedly screwed to head girders are also known from documents DE 1 229 262 A and DE 1 175 840 A, laid open for public inspection.

SUMMARY OF THE INVENTION

The object of the invention is to provide a crane having a laterally projecting crane jib, in particular a bracket crane or travelling crane, whose manufacture, transport and assembly are optimised.

In accordance with an embodiment of the invention, in the case of a crane having a laterally projecting crane jib on which a hoisting device is disposed and which is connected to at least one support body which, together with the crane jib, can travel along an upper running rail and a lower running rail via travelling mechanisms, wherein in each case the upper and the lower running rails and accordingly the travelling mechanisms are disposed so as to be vertically spaced apart from each other, assembly, transport and manufacture are facilitated by virtue of the fact that the at least one support body is formed as a structural unit and on which connection surfaces are disposed, to which in each case one of the travelling mechanisms and the crane jib can be releasably attached. Owing to the separation, in manufacturing, of the support body and crane jib, it is advantageously possible to combine different materials. For example, the support body can consist of an aluminium alloy or of composite materials and the crane jib can consist of a steel material.

The crane in accordance with the invention having a laterally projecting crane jib is also referred to as a bracket crane. This bracket crane differs from the previously described bridge cranes in that the main girder of a bridge crane extends between two running rails extending spaced apart from each other in a horizontal plane and lies with its two ends on the running rails for example via travelling mechanisms. The main girder of such a bridge crane is thus not a freely projecting crane jib in terms of the present invention. A projecting crane jib of a bracket crane comprises a free first end. The free first end is neither attached to a support body of the bracket crane nor does it lie on a running rail. In other words, a support body is connected merely to a second end of the crane jib and faces the running rails and is remote from the free first end. In the case of a bracket crane formed as a travelling crane, the running rails extend vertically spaced apart from each other along a wall. The travelling mechanisms, via which such a bracket crane or travelling crane travels along the running rails, are thus disposed in the region of the non-free second end of the crane jib and the support body located in this position.

Optimisation of manufacturing in the sense that in particular the support body can be manufactured in a single clamping step is achieved by virtue of the fact that all of the connection surfaces are disposed on the at least one support body. Consequently, it is also possible to achieve particularly high manufacturing accuracy. Therefore, the support body or the connection surfaces exclusively disposed thereon, in particular the connection surfaces for the travelling mechanisms, are particular dimensionally stable which means that alignment effort during assembly and disassembly can be reduced. The high manufacturing accuracy moreover results in improved travelling behaviour of the crane, whereby dynamic effects are reduced, the wear of mechanical components such as for example the running wheels is reduced and the service life of the crane is increased.

A modular crane construction is achieved by virtue of the fact that a crane jib connection surface is disposed on the crane jib and a travelling mechanism connection surface is disposed on each travelling mechanism, whereby simplified and separate transport of the travelling mechanisms and of the crane jib to the destination is possible.

Simplified manufacture is additionally achieved by virtue of the fact that connection bores are provided on the connection surfaces, crane jib bores are provided on the crane jib connection surface and housing bores are provided on the travelling mechanism connection surfaces.

In a constructionally simple structure, provision is made that one of the travelling mechanism connection surfaces is disposed on a lateral first or second housing wall of the travelling mechanism.

For simple and rapid assembly, disassembly and simple replacement of components at the destination of the crane, it is particularly advantageous that all of the travelling mechanisms and the crane jib can be attached to one of the connection surfaces in each case via releasable connection means.

In a constructionally simple structure, two travelling mechanisms vertically spaced apart from each other are disposed on the at least one support body and act in mutually opposite directions with regard to the forces introduced from the crane jib. The forces acting on the laterally projecting crane jib are hereby reliably fed into the running rails.

An embodiment which is improved in particular with regard to stability and running smoothness makes provision that a third travelling mechanism is disposed on the at least one support body and, with regard to the forces introduced from the crane jib, acts in a direction which is different from the corresponding directions of the first and second travelling mechanisms.

In a particularly advantageous embodiment the travelling mechanisms each comprise at least one running wheel.

The costs in particular in relation to maintaining required manufacturing tolerances can additionally be minimised in that the at least one running rail comprises at least one running surface which is the surface of a rail disposed on the at least one running rail. This additional rail can be particularly effectively machined in a calculated manner.

The good spatial coverage achieved by the laterally projecting crane jib is additionally increased and made flexible in that the hoisting device can travel along the crane jib.

An exemplified embodiment of the invention is explained in more detail with the aid of the following description.

DESCRIPTION OF THE PREFERRED EMBODIMENTS

Figure 1:
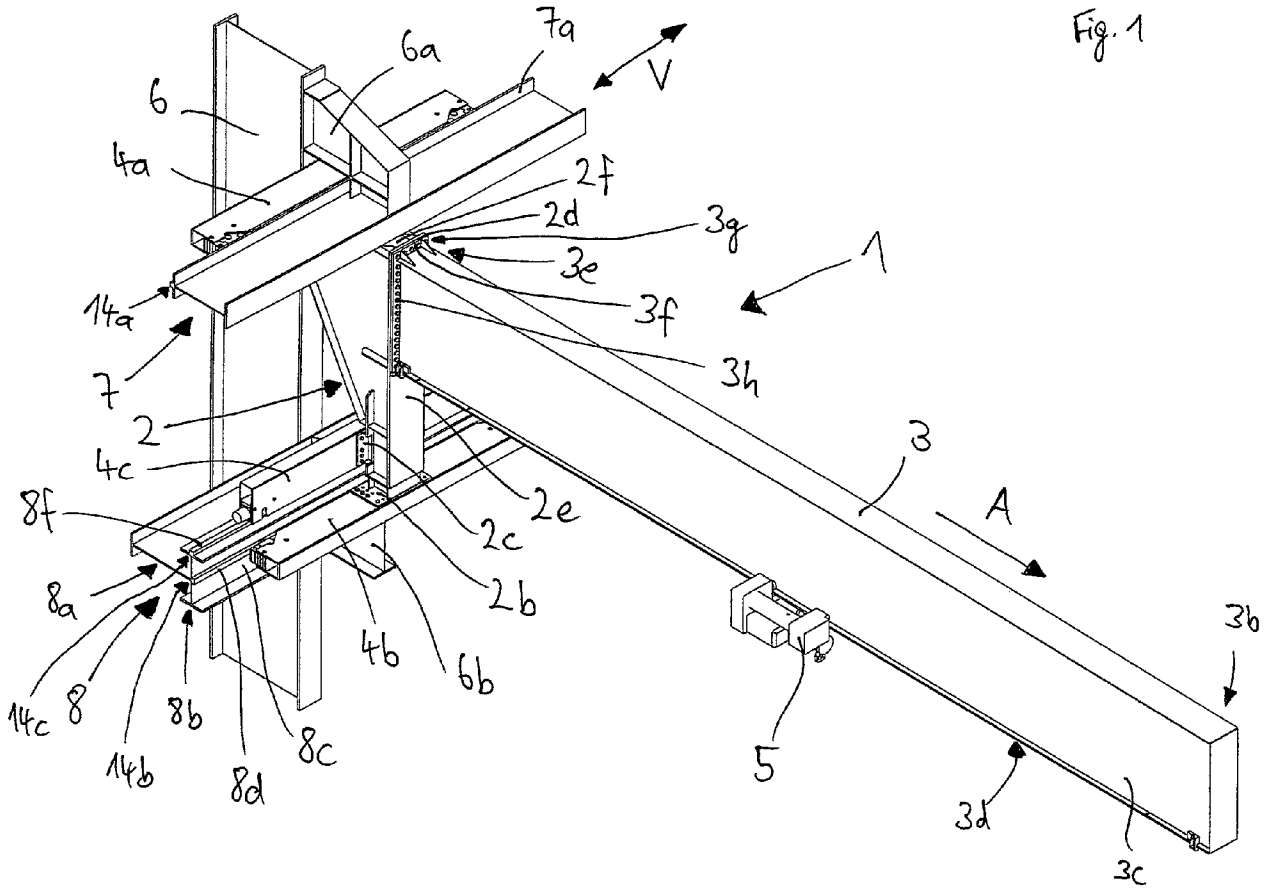
FIG. 1 shows a perspective view of a crane which is formed as a travelling crane.

FIG. 1 shows a crane 1 formed as a travelling crane having a support body 2 which can travel on running rails 7, 8 and to which a crane jib 3 is attached so as to project laterally in a projection direction A. The crane jib 3 accommodates a trolley having a hoisting device 5 which can travel along the crane jib 3. Of course, it is also possible to attach a hoisting device to the crane jib 3 in a positionally-fixed manner. It is further possible to dispose more than one crane jib 3 on the support body 2 and on the other hand to suspend more than one trolley having a hoisting device 5 on each crane jib 3 either in a positionally fixed manner or in a manner permitting travel.

A first, second and third travelling mechanism 4*a*, 4*b* and 4*c* are attached to the support body 2. The crane 1 is supported via the travelling mechanism 4*a* on an upper running rail 7 and via the travelling mechanisms 4*b*, 4*c* on a lower running rail 8. The upper running rail 7 and the lower running rail 8 are attached to a vertical girder 6 via a support structure 6*a*, 6*b*, which girder is, or can be, a component of a wall, not illustrated. The crane 1 can thus travel as a travelling crane along the upper and lower running rails 7 and 8 and in a substantially horizontal direction of travel V. In a departure from the embodiment as a travelling crane, the girder 6 which supports the upper and lower running rails 7, 8 can also be a free-standing component of a column structure which is not directly a component of a wall.

The support body 2 has a flat, elongate rectangular shape having protrusions and comprises a total of four connection surfaces 2*a* to 2*d* which will be described in more detail hereinafter (see also FIGS. 2 and 3) and, as seen in a plane containing the projection direction A, are directed in different directions arranged perpendicularly with respect to each other—in particular upwards and downwards in, opposite and transversely with respect to the projection direction A. The connection surfaces 2*a* to 2*d* are located indirectly or directly on walls 2*e* to 2*h* of the support body 2 (see also FIG. 3).

The fourth connection surface 2*d*, to which the crane jib 3 is attached on one side by means of a releasable screw connection via a crane jib connection surface 3*a* (see FIG. 2), is provided in the lateral fourth wall 2*e* of the support body 2. Therefore, a free end 3*b* of the crane jib 3 freely projects from the support body 2 in the projection direction A perpendicularly directed away with respect to the direction of travel V. The crane jib 3 is formed to be flat, box-shaped and elongate in the projection direction A, i.e., it has a greater height than width as seen in the projection direction A. The crane jib 3 also has in addition to a free end 3*b* an opposite connection end 3*e*. In order to be able to provide a rail-like lower region 3*d* of the crane jib 3 which is used to accommodate and move the trolley having the hoisting device 5 in or opposite the projection direction A, two opposite-lying lateral crane jib walls 3*c* are set back inwardly transversely with respect to the projection direction A of the crane jib 3. The crane jib connection surface 3*a* is provided on the connection end 3*e* in the form of a connection plate 3*g*. As seen from the free end 3*b*, the only part of the connection plate 3*g* which can be seen is a flange-like collar 3*f* which protrudes beyond the cross-sectional contour of the crane jib 3 laterally and at the top in a collar-like manner. Several crane jib bores covered by screws 3*h* are provided in the protruding collar 3*f* of the connection plate 3*g* and are disposed in a complementary manner with respect to several connection bores 2*n* (see FIG. 3) of the fourth connection surface 2*d*. The crane jib bores and thus also the screws 3*h* are evenly distributed along the collar 3*f*. Of course, it is also possible for the crane jib 3 to be formed as a profiled girder consisting of commercially available rolled profiles or of specialised profiles formed in a different manner, instead of the box shape illustrated in this case.

An upwardly directed first connection surface 2*a* (see FIGS. 2 and 3) is provided on a horizontal upper first wall 2*f* of the support body 2 and a downwardly directed second connection surface 2*b* in parallel with the first connection surface 2*a* is provided on a horizontal lower second wall 2*g* (see FIGS. 2 and 3) of the support body 2. In addition, a third connection surface 2*c* is provided on a lateral third wall 2*h* (see FIGS. 2 and 3) of the support body 2, which third connection surface lies opposite the fourth wall 2*e* and is directed away therefrom.

The travelling mechanisms 4*a*, 4*b*, 4*c* are each designed with an identical construction. A main component is an elongate and tubular travelling mechanism housing 11 having a rectangular cross-section. The travelling mechanism housing 11 comprises in each case a travelling mechanism connection surface 4*d*, 4*e*, 4*f*, not illustrated, and in each case a first and second running wheel 12, 13 are mounted therein in a rotatable manner (see FIG. 4). The first travelling mechanism 4*a* is attached to the support body 2 by means of a releasable screw connection between the first travelling mechanism connection surface 4*d* and the first connection surface 2*a*, and the second travelling mechanism 4*b* is attached to the support body 2 by means of a releasable screw connection between the second travelling mechanism connection surface 4*e* and the second connection surface 2*b*. The third travelling mechanism 4*c* is attached to the support body 2 by means of a releasable screw connection between the third travelling mechanism connection surface 4*f* and the third connection surface 2*c*.

The upper running rail 7 is formed in the shape of an I girder having a web and two flanges and extends in the direction of travel V, wherein the web is oriented horizontally. On a rear—as seen from the free end 3*b* of the crane jib 3—first flange 7*a*, a first rail 14*a* extending in the direction of travel V—i.e., in the longitudinal direction of the upper running rail 7—and having a rectangular cross-section is welded on the outside at the level of the web. The surface, not illustrated, of the first rail 14*a* acts as a vertical first running surface 7*b* (see FIG. 2) which has the first travelling mechanism 4*a* lying against it.

The lower running rail 8 consists of a T-girder-shaped first region 8*a* having a web and a flange. The first region 8*a* is disposed below the upper running rail 7. The web of the first region 8*a* is also aligned in parallel with the upper running rail 7, wherein the end of the web remote from the flange is directed in the direction of the free end 3*b* of the crane jib 3. This end of the web of the first region 8*a* is laterally attached to an I-shaped second region 8*b* of the lower running rail 8 having a web 8*c* and two flanges and is attached centrally to the web 8*c*. The web of the first region 8*a* is disposed perpendicularly with respect to the web 8*c* of the second region 8*b*. Provided on the lower running rail 8 is a vertical second running surface 8*d*, which has the second travelling mechanism 4*b* lying against it, by virtue of the fact that a second rail 14*b* is welded in the longitudinal direction on the side of the web 8*c* directed in the projection direction A at the level of the web of the first region 8*a*. A horizontal third running surface 8*f* on the lower running rail 8, which has the third travelling mechanism 4*c* lying against it, is provided by virtue of the fact that a third rail 14*c* is welded centrally and in the longitudinal direction on an upper second flange 8*e*. The contacting relationships between the travelling mechanisms 4*a*, 4*b*, 4*c* and the rails 14*a*, 14*b*, 14*c* or the running surfaces 7*b*, 8*d*, 8*f* are shown in detail in FIG. 2.

Owing to the described construction of the crane 1, the occurring moments and the horizontal or vertical forces resulting therefrom are fed into the upper running rail 7 and into the lower running rail 8 substantially via the travelling mechanisms 4*a*, 4*b* and 4*c* corresponding to the respective travelling mechanism orientation.

The orientation of the travelling mechanism connection surfaces 4*d* and 4*e* and thus of the first and second travelling mechanism 4*a* and 4*b* in the assembled state can also be effected, in addition to the illustrated horizontal orientation, vertically or in an angled intermediate position if the upper or lower running rail 7 or 8 respectively are reconfigured accordingly. This is also true for the third travelling mechanism 4*c* and the corresponding third travelling mechanism connection surface 4*f*.

Figure 2:
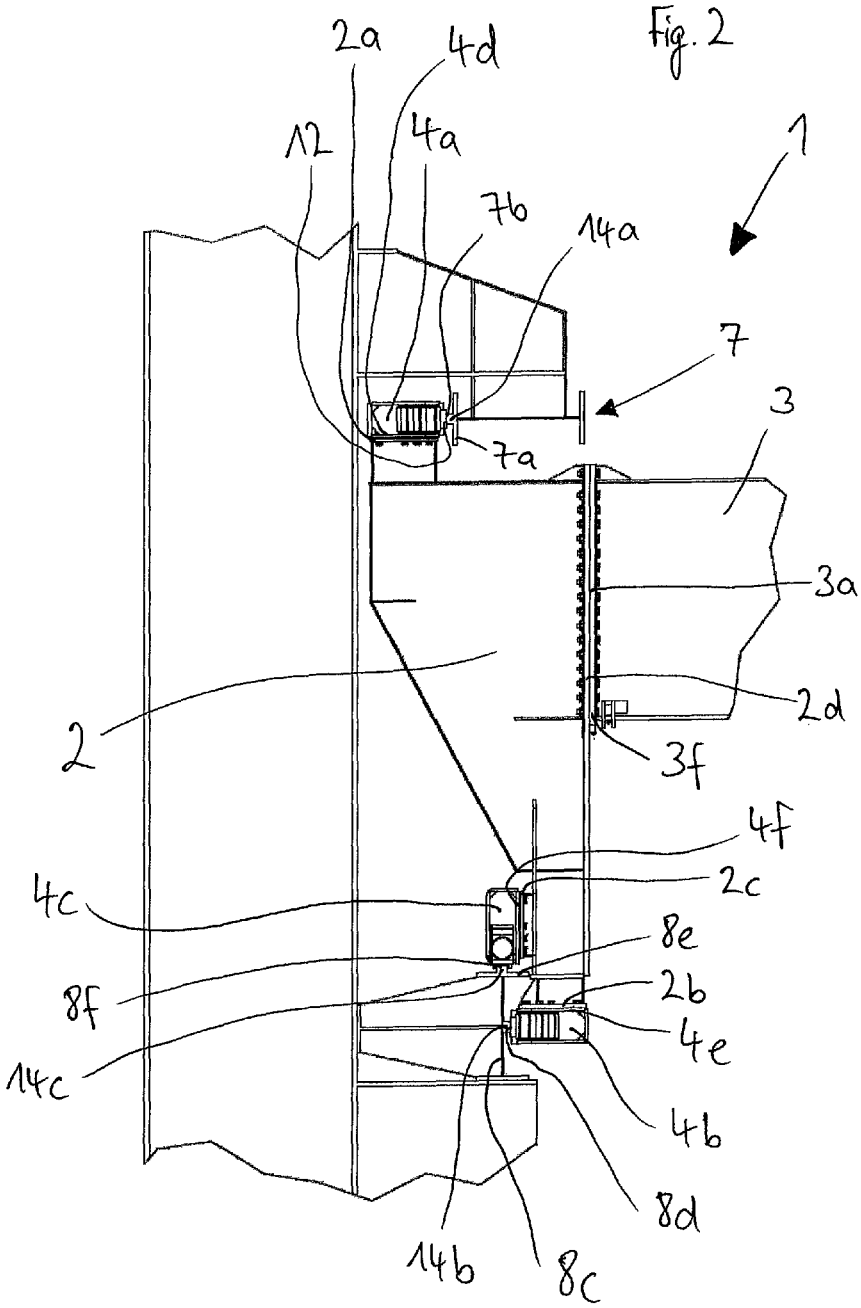
FIG. 2 shows a lateral, partial view of the crane of FIG. 1.

FIG. 2 illustrates a lateral, partial view of the crane 1, in particular the screw connections between the crane jib connection surface 3*a* of the collar 3*f* and the fourth connection surface 2*d*, between the first travelling mechanism connection surface 4*d* and the first connection surface 2*a*, between the second travelling mechanism connection surface 4*e* and the second connection surface 2*b* and between the third travelling mechanism connection surface 4*f* and the third connection surface 2*c*. It is also shown how the first running wheel 12 and the second running wheel 13, not illustrated, of the first travelling mechanism 4*a* are in contact with, and roll on, the first running surface 7*b*. The contacting relationships between the travelling mechanism 4*b* and 4*c* and the second running surface 8*d* and third running surface 8*f* respectively are also shown.

Figure 3:
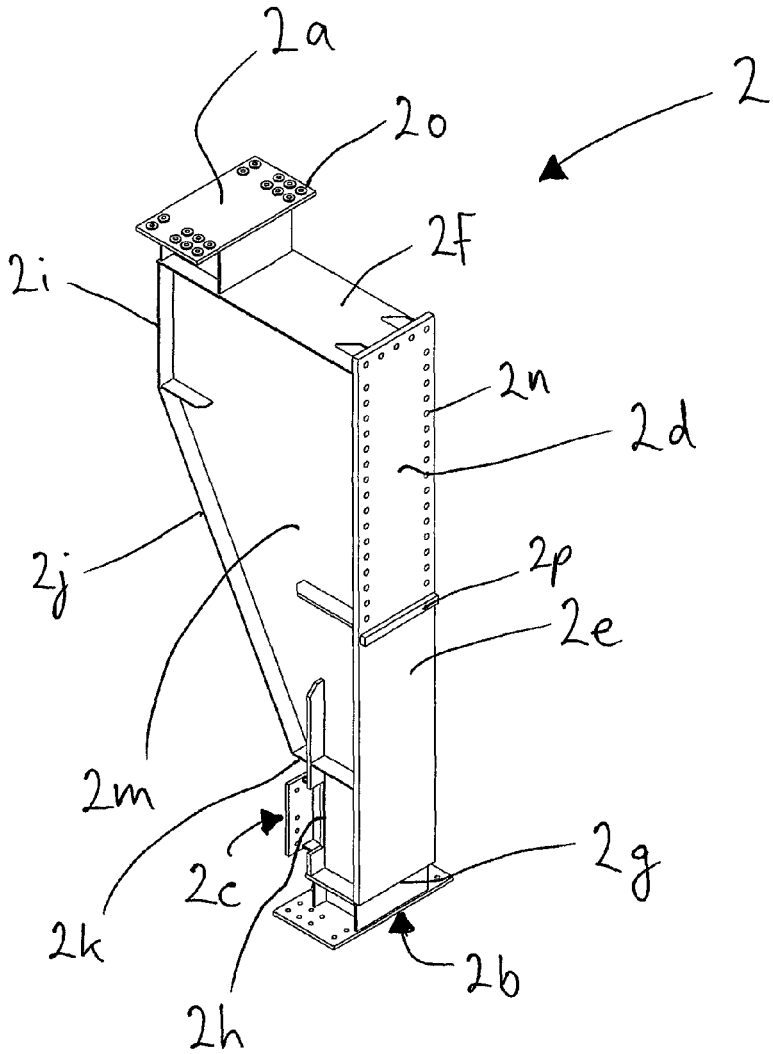
FIG. 3 shows a perspective view of a support body of the crane.

FIG. 3 illustrates the support body 2 having the four connection surfaces 2*a* to 2*d* which are provided on the walls 2*e* to 2*h*. The substantially box-shaped design of the support body 2 has, on a side opposite the fourth wall 2*e*, a wall progression which substantially drops back in an inclined manner and is formed by further walls 2*i* to 2*k*. The vertical fifth wall 2*i*, directed downwards, adjoins the upper first wall 2*f* opposite, and in parallel with, the fourth wall 2*e*. The distance of the wall progression in relation to the fourth wall 2*e* decreases constantly and linearly over an inclined region and ends with a set-back step on the vertical third wall 2*h*. Therebetween, the sixth wall 2*j* which extends in an inclined manner adjoins at the top the fifth wall 2*i* and at the bottom the horizontal wall 2*k* connected to the third wall 2*h*. The frame formed by the aforementioned seven walls 2*e* to 2*k* is closed on both sides by two sidewalls 2*m*, wherein the sidewalls 2*m* are each set back inwardly with respect to the outer edges of the frame. The fourth connection surface 2*d* is formed integrated in the sidewall 2*e*, wherein several connection bores 2*n* are provided in an evenly distributed manner in a U-shaped progression in an upper edge region of the fourth wall 2*e*. The connection surfaces 2*a*, 2*b*, 2*c*, which are attached indirectly to the support body 2 in the form of connection plates, each have several connection bores having insertion sleeves 2*o*. Of course, the connection surfaces 2*a* to 2*d* can also be embodied in a manner different from that illustrated. It is also possible that some of the connection surfaces 2*a* to 2*d* are disposed adjacently such that the corresponding surfaces merge into each other and only the connection of the travelling mechanisms 4*a*, 4*b*, 4*c* or of the crane jib 3 effects local delimitation. For example, it is also feasible that two crane jibs 3 are attached to the support body 2 and for this two separate connection surfaces are provided from the outset, or that a common connection surface accommodates the two crane jibs 3. Moreover, a projecting edge 2*p* formed in a rod-shaped manner having a rectangular cross-section is disposed on the fourth wall 2*e* so as to be oriented in a horizontal transverse manner. The upper side of the projecting edge 2*p* is used as an abutment on which the lower region 3*d* of the connection end 3*e* of the crane jib 3 lies during assembly and in the assembled state.

Figure 4:
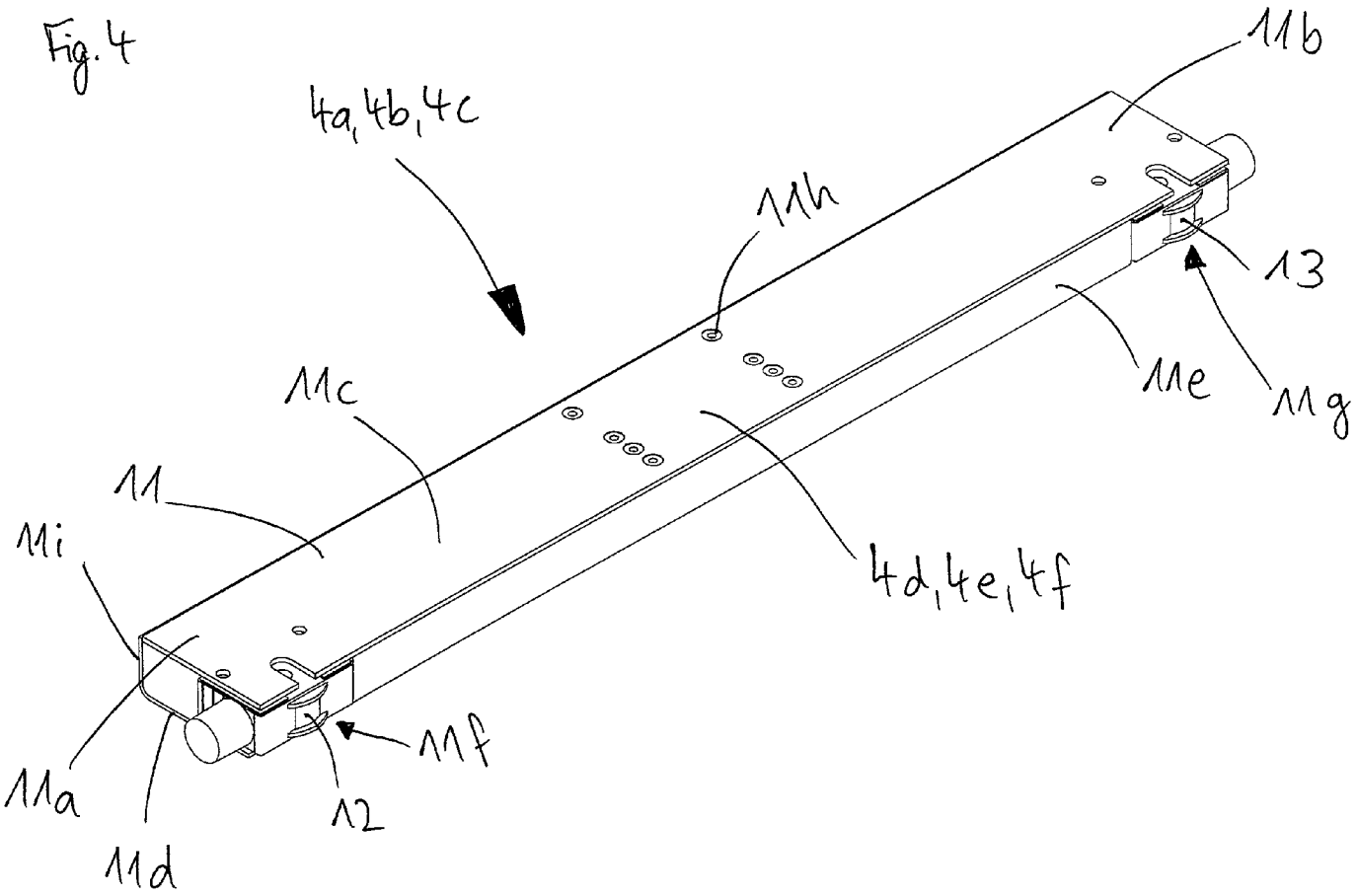
FIG. 4 shows a perspective view of a travelling mechanism of the crane.

FIG. 4 shows exemplarily a perspective view of the construction of a travelling mechanism 4*a*, 4*b*, 4*c*. Between two elongate and parallel housing walls 11*c*, 11*d* of the box-shaped travelling mechanism housing 11 the first running wheel 12 is mounted in a rotatable manner on a left end 11*a* and the second running wheel 13 is mounted in a rotatable manner on a right end 11*b*. The running wheels 12, 13 each protrude, on the left or right end 11*a*, 11*b* respectively of the travelling mechanism 11, partly from in each case a left and a right opening 11*f*, 11*g* of a third housing wall 11*e*. Alternatively, it is also possible to accommodate more than two running wheels in the travelling mechanism housing 11. In addition, several housing bores 11*h* are provided in the first housing wall 11*c* or in the second housing wall 11*d* in the region of the travelling mechanism connection surfaces 4*d*, 4*e*, 4*f*, wherein the respective screwing of the travelling mechanisms 4*a*, 4*b*, 4*c* to the corresponding connection surfaces 2*a*, 2*b*, 2*c* of the support body 2 is effected via the housing bores. In a departure from the embodiment illustrated in FIGS. 1, 2 and 4, it is likewise possible that the housing bores 11*h* are not provided in the lateral first or second housing walls 11*c*, 11*d* but are provided in an upper fourth housing wall 11*i*. A travelling mechanism 4*a*, 4*b*, 4*c* formed in this manner would thus be connected to the support body 2 not as a "lateral connection" but as an "upper connection"—in relation to the upper housing wall 11*i* thereof and independent of its spatial orientation in the assembled state. Each of the travelling mechanisms 4*a*, 4*b*, 4*c* can be designed to be driven or non-driven.

LIST OF REFERENCE NUMERALS

1 Crane
2 Support body
2*a* First connection surface
2*b* Second connection surface
2*c* Third connection surface
2*d* Fourth connection surface
2*e* Fourth wall
2*f* First wall
2*g* Second wall
2*h* Third wall
2*i* Fifth wall
2*j* Sixth wall
2*k* Seventh wall
2*m* Sidewall
2*n* Connection bore
2*o* Connection bore having insertion sleeve
2*p* Projecting edge
3 Crane jib
3*a* Crane jib connection surface
3*b* Free end
3*c* Crane jib wall
3*d* Lower region
3*e* Connection end
3*f* Collar
3*g* Connection plate
3*h* Screws
4*a* First travelling mechanism
4*b* Second travelling mechanism
4*c* Third travelling mechanism
4*d* First travelling mechanism connection surface
4*e* Second travelling mechanism connection surface
4*f* Third travelling mechanism connection surface
5 Trolley having hoisting device
6 Girder
6*a* Upper support structure
6*b* Lower support structure
7 Upper running rail
7*a* First flange
7*b* First running surface
8 Lower running rail
8*a* First region
8*b* Second region
8*c* Web
8*d* Second running surface
8*e* Second flange
8*f* Third running surface
11 Travelling mechanism housing
11*a* Left end
11*b* Right end
11*c* First housing wall
11*d* Second housing wall
11*e* Third housing wall
11*f* Left opening
11*g* Right opening
11*h* Housing bore
11*i* Fourth housing wall
12 First running wheel
13 Second running wheel
14*a* First rail
14*b* Second rail
14*c* Third rail
A Projection direction
V Direction of travel

The invention claimed is:

1. Crane having a laterally projecting crane jib on which a hoisting device is disposed and which is connected to at least one support body which, together with the crane jib, configured to travel along an upper running rail and a lower running rail via travelling mechanisms, wherein in each case the upper and the lower running rails and accordingly the travelling mechanisms are disposed so as to be vertically spaced apart from each other, wherein the at least one support body is formed as a structural unit and on which connection surfaces are disposed, to which in each case one of the travelling mechanisms and the crane jib can be releasably attached, wherein a crane jib connection surface is disposed on the crane jib and a travelling mechanism connection surface is disposed on each travelling mechanism, and wherein connection bores are provided on the connection surfaces, crane jib bores are provided on the crane jib connection surface and housing bores are provided on the travelling mechanism connection surfaces.

2. Crane as claimed in claim 1, wherein all of the connection surfaces are disposed on the at least one support body.

3. Crane as claimed in claim 2, wherein one of the travelling mechanism connection surfaces is disposed on a lateral first or second housing wall of the travelling mechanism.

4. Crane as claimed in claim 2, wherein one of the travelling mechanism connection surfaces is disposed on a lateral first or second housing wall of the travelling mechanism.

5. Crane as claimed in claim 2, wherein all of the travelling mechanisms and the crane jib can be attached to one of the connection surfaces in each case via releasable connection means.

6. Crane as claimed in claim 2, wherein the travelling mechanisms each comprise at least one running wheel.

7. Crane as claimed in claim 2, wherein at least one of the upper running rail and the lower running rail comprises at least one running surface which is the surface of a rail disposed on the respective upper running rail and/or lower running rail.

8. Crane as claimed in claim 2, wherein the hoisting device can travel along the crane jib.

9. Crane as claimed in claim 1, wherein one of the travelling mechanism connection surfaces is disposed on a lateral first or second housing wall of the travelling mechanism.

10. Crane as claimed in claim 1, wherein all of the travelling mechanisms and the crane jib can be attached to one of the connection surfaces in each case via releasable connection means.

11. Crane as claimed in claim 1, wherein two travelling mechanisms vertically spaced apart from each other comprising a first travelling mechanism and a second travelling mechanism are disposed on the at least one support body and act in mutually opposite directions with regard to the forces introduced from the crane jib.

12. Crane as claimed in claim 11, wherein a third travelling mechanism is disposed on the at least one support body and, with regard to the forces introduced from the crane jib, acts in a direction which is different from the corresponding directions of the first and second travelling mechanisms.

13. Crane as claimed in claim 1, wherein the travelling mechanisms each comprise at least one running wheel.

14. Crane as claimed in claim 1, wherein at least one of the upper running rail and the lower running rail comprises at least one running surface which is the surface of a rail disposed on the respective upper running rail and/or lower running rail.

15. Crane as claimed in claim 1, wherein the hoisting device can travel along the crane jib.

16. Crane as claimed in claim 1, wherein two travelling mechanisms vertically spaced apart from each other comprising a first travelling mechanism and a second travelling mechanism are disposed on the at least one support body and act in mutually opposite directions with regard to the forces introduced from the crane jib.

17. Crane as claimed in claim 16, wherein a third travelling mechanism is disposed on the at least one support body and, with regard to the forces introduced from the crane jib, acts in a direction which is different from the corresponding directions of the first and second travelling mechanisms.

* * * * *